US005462178A

United States Patent [19]

Wallach et al.

[11] Patent Number: 5,462,178

[45] Date of Patent: Oct. 31, 1995

[54] REVOLVING DISPLAY STAND

[75] Inventors: Stewart Wallach, Boca Raton; Jacqueline Cabana, Oldsmar, both of Fla.

[73] Assignee: Sagaz Industries, Inc., Miami, Fla.

[21] Appl. No.: 259,292

[22] Filed: Jun. 13, 1994

[51] Int. Cl.[6] ..... A47F 5/00

[52] U.S. Cl. ..... 211/95; 211/163

[58] Field of Search ..... 211/163, 95, 48, 211/58, 115

[56] References Cited

U.S. PATENT DOCUMENTS

| | | | |
|---|---|---|---|
| 923,705 | 6/1909 | Reyher | 211/163 |
| 2,868,386 | 1/1959 | Seyforth | 211/95 |
| 2,941,669 | 6/1960 | Palay et al. . | |
| 2,972,420 | 2/1961 | Tucci | 211/95 |
| 3,535,959 | 4/1969 | Berman et al. . | |
| 3,693,807 | 9/1972 | Larsen . | |
| 3,874,512 | 4/1975 | Wegley et al. | 211/163 |
| 4,111,307 | 9/1978 | Peggs . | |
| 4,269,124 | 5/1981 | Rosenthal et al. | 211/163 X |
| 5,228,582 | 7/1993 | Marshall et al. . | |

FOREIGN PATENT DOCUMENTS

| | | | |
|---|---|---|---|
| 1111930 | 7/1961 | Germany | 211/163 |

*Primary Examiner*—Robert W. Gibson, Jr.
*Attorney, Agent, or Firm*—Howard & Howard

[57] ABSTRACT

The present invention is an upright revolving display stand (10,10') of the type for displaying articles of merchandise (66,66') and of the type supported by both a base floor portion (12,12') and an upright wall portion. (14,14') extending from the base floor portion (12,12'). The display stand (10,10') is characterized by a display rack (46,46') coupled to the pole (24,24').

19 Claims, 3 Drawing Sheets

REVOLVING DISPLAY STAND

TECHNICAL FIELD

The subject invention relates to revolving display stands for displaying articles of merchandise. More specifically, the present invention relates to revolving display stands for displaying vehicular floor mats.

BACKGROUND OF THE INVENTION

Most stores which sell automobile-related products have limited floor space in which to display their products. The typical automobile floor mat is quite cumbersome, bulky, and difficult to place within restrictive small-sized packages. Currently, automobile floor mats are packaged by using an anchor which is clamped or attached to the floor mats to suspend the floor mats on a display bar. Thus, the floor mats are displayed in an unfolded condition such that a consumer may view the mat for color and design features. U.S. Pat. No. 5,257,694, of common assignee herewith and issued Nov. 2, 1993, exemplifies the current state of the art for automobile floor mat packaging. Retailers need an efficient manner to display floor mat packages of this type in their stores. Currently, these floor mat packages are hung on a display bar extending from the store walls or shelves. This limits the amount of floor mat packages which can be displayed per floor display area. Also, it is difficult for customers to inspect the floor mat packages which are nearest to the wall or shelf due to the number of other floor mat packages on the display bar.

Thus, what is needed is a display stand tailored for displaying floor mat packages of the type described in U.S. Pat. No. 5,257,694 in a convenient manner for customer inspection while minimizing the space needed to display the maximum number of floor mat packages. Additionally, a display stand for displaying automobile floor mats is needed which is adaptable to current store display fixtures/shelves of the type having a base floor portion and an upright wall portion extending upwardly from the base floor portion wherein the wall portion has strips adapted to receive mounting brackets having hooks. It is also desirous to have such a display stand which can be easily manufactured, assembled and packaged.

The prior art is represented by U.S. Pat. Nos. 2,941,669, 3,435,959, and 3,693,807. However, the display stands disclosed in these patents do not meet the specific needs for displaying automobile floor mats.

SUMMARY OF THE INVENTION AND ADVANTAGES

The present invention is an upright revolving display stand of the type for displaying articles of merchandise and of the type supported by both a base floor portion and an upright wall portion extending from the base floor portion.

In one embodiment, the revolving display stand comprises a pole having a first end and a second end, first rotation means adapted to be secured to the base floor portion for rotatably supporting the first end of the pole, and a mounting bracket adapted to be secured to the upright wall portion. The revolving stand also comprises a cantilevered beam extending outwardly from the mounting bracket to a distal end. The cantilevered beam has second rotation means at the distal end for rotatably supporting the second end of the pole so that the pole is rotatable about the first and second rotation means. The display stand is characterized by at least one display rack including a collar secured to the pole, three support arms extending radially from the collar, and a triangular frame attached to the support arms at the apexes thereof for supporting the articles of merchandise to be displayed.

In another embodiment, the revolving display stand comprises a pole having a first end and a second end, first attachment means adapted to be secured to the base floor portion for fixedly attaching the first end of the pole to the base floor portion and a mounting bracket adapted to be secured to the upright wall portion. The revolving display stand also comprises a cantilevered beam extending outwardly from the mounting bracket to a distal end. The cantilevered beam has a second attachment means for fixedly securing the second end of the pole to the beam so that the pole is fixedly secured between said first and second attachment means. The display stand is characterized by at least one display rack rotatable about the pole and including a collar secured to the pole, an upper and lower support plate, a bearing unit mounted to and between the upper and lower support plates such that the bearing unit and the upper and lower support plates are rotatable about the pole and supported upon the collar, and support arms extending radially from said bearing unit outwardly beyond the support plates for supporting articles of merchandise to be displayed.

FIGURES IN THE DRAWINGS

DETAILED DESCRIPTION OF THE PREFERRED EMBODIMENT

Figure 1:
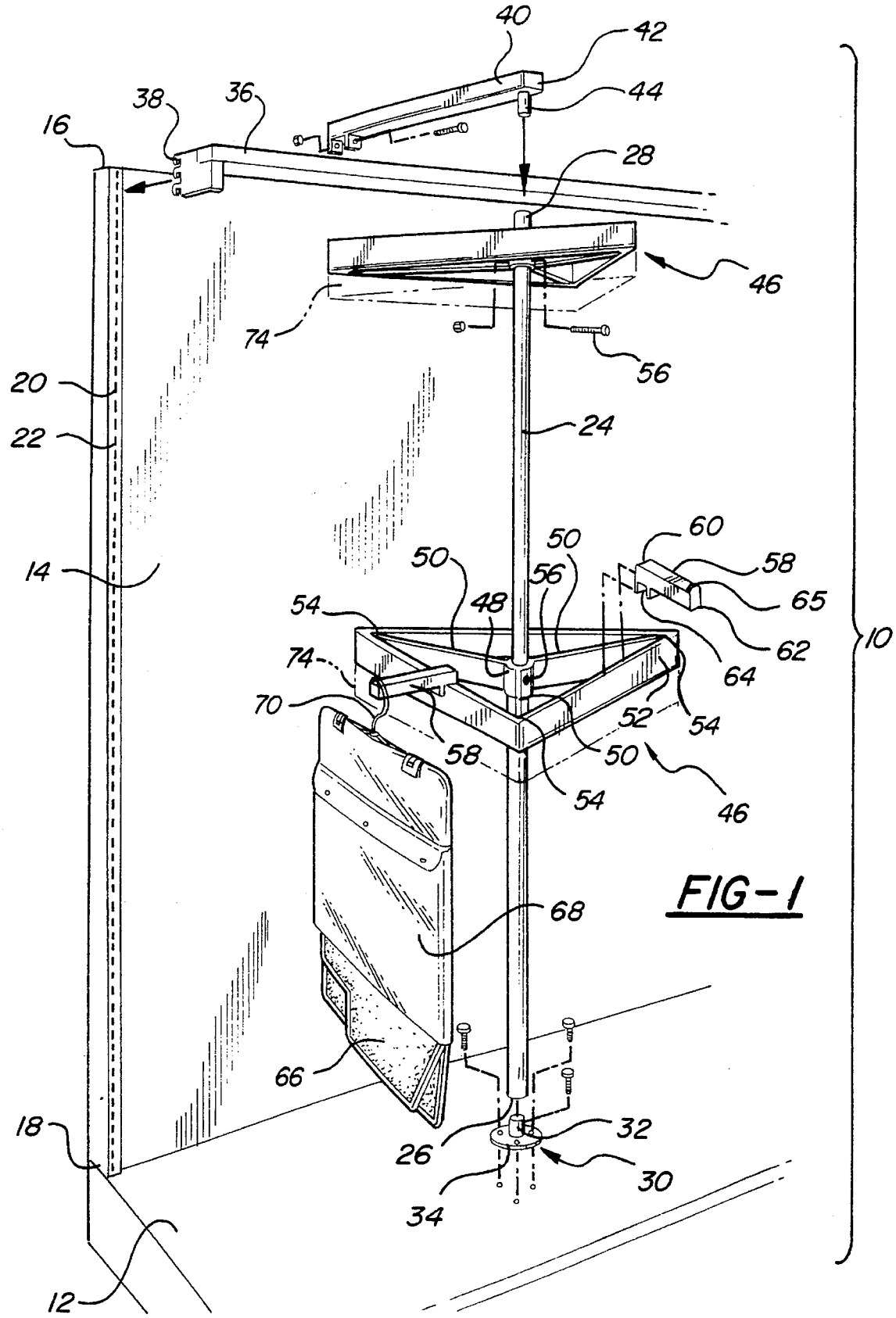
FIG. 1 is a partially exploded perspective view of the revolving display stand of the subject invention showing packaged floor mats hanging therefrom.

Referring to FIG. 1, the revolving display stand of the subject invention is generally shown at 10. The display stand 10 is adapted to be secured to a base floor portion 12 and an upright wall portion 14. The upright wall portion 14 has an upper end 16 and a lower end 18. The lower end 18 is secured to the base floor portion 12. The upright wall portion 14 includes mounting strips 20 running vertically from the upper end 16 to the lower end 18. The mounting strips 20 comprise a plurality of slots 22 for receiving brackets having hooks. Mounting strips 20 and bracket combinations of these type are normally used to support shelves and articles of merchandise. The mounting strips 20 are usually made from a rigid metal.

The revolving display stand 10 of the present invention comprises a pole 24 having a first hollow end 26 and a second hollow end 28. The pole can be made from metal, plastic, or any other material which provides substantial rigidity to support the articles of merchandise to be displayed. The display stand 10 also comprises first rotation means 30 adapted to be secured to the base floor portion 12 for rotatably supporting the first end 26 of the pole 24. First rotation means may take on many different forms such as a bottom guide pin 30 for extending into the first hollow end 26 of the pole 24, an aperture in the base floor portion for receiving the first end 26 of the pole 24 (not shown), or a bracket mounted to the base floor portion having an aperture for receiving the first end 26 of the pole 24 (also not shown). As shown in FIG. 1, the bottom guide pin 30 includes a pin portion 32 and a plate 34 for securing the bottom guide pin 30 to the base floor portion 12 via conventional means such as nuts and bolts. A mounting bracket 36 is adapted to be secured to the upright wall portion 14. The mounting bracket 36 has hooks 38 extending therefrom for adjustably securing the mounting bracket 36 to the mounting strips 20 on the upright wall portion 14. The hooks 38 are inserted into the slots 22 of the mounting strips 20. It will be appreciated that the mounting bracket 36 may employ other means for attaching the bracket 36 to the upright wall portion 14. The display stand 10 also includes a cantilevered beam 40 extending outwardly from the mounting bracket 36 to a distal end 42. The cantilevered beam 40 is attached to the mounting bracket 36 via nuts and bolts. The cantilevered beam 40 includes second rotation means 44 located at the distal end 42 for rotatably supporting the second hollow end 28 of the pole 24 so that the pole 24 is rotatable about the first 30 and second 44 rotation means. As shown in FIG. 1, second rotation means 44 comprises a guide pin 44 extending from the distal end 42 of the cantilevered beam 40.

The display stand is characterized by at least one display rack 46 including a collar 48 secured to the pole 24, three support arms 50 extending radially from the collar 48 and a triangular frame 52 attached to the support arms 50 at the apexes 54 thereof for supporting articles of merchandise to be displayed. The display rack 46 is secured to the pole 24 by a bolt 56 extending through the collar 48 and pole 24, In the preferred embodiment, there is one display bar 58 per side of the triangular frame 52. Each display bar 58 extends outwardly from the frame 52 for hanging the articles of merchandise to be displayed. Each display bar 58 comprises a first end 60, a second end 62, a saddle portion 64 located at the first end 60 for straddling the frame 52 such that each of the display bars 58 extend outwardly from the frame 52 to the second end 62 in a rigid manner. Each of the display bars 58 also has a blocking tab 65 located at the second end 62 for preventing inadvertent removal of the articles of merchandise hung from each of the display bars 58.

Figure 2:
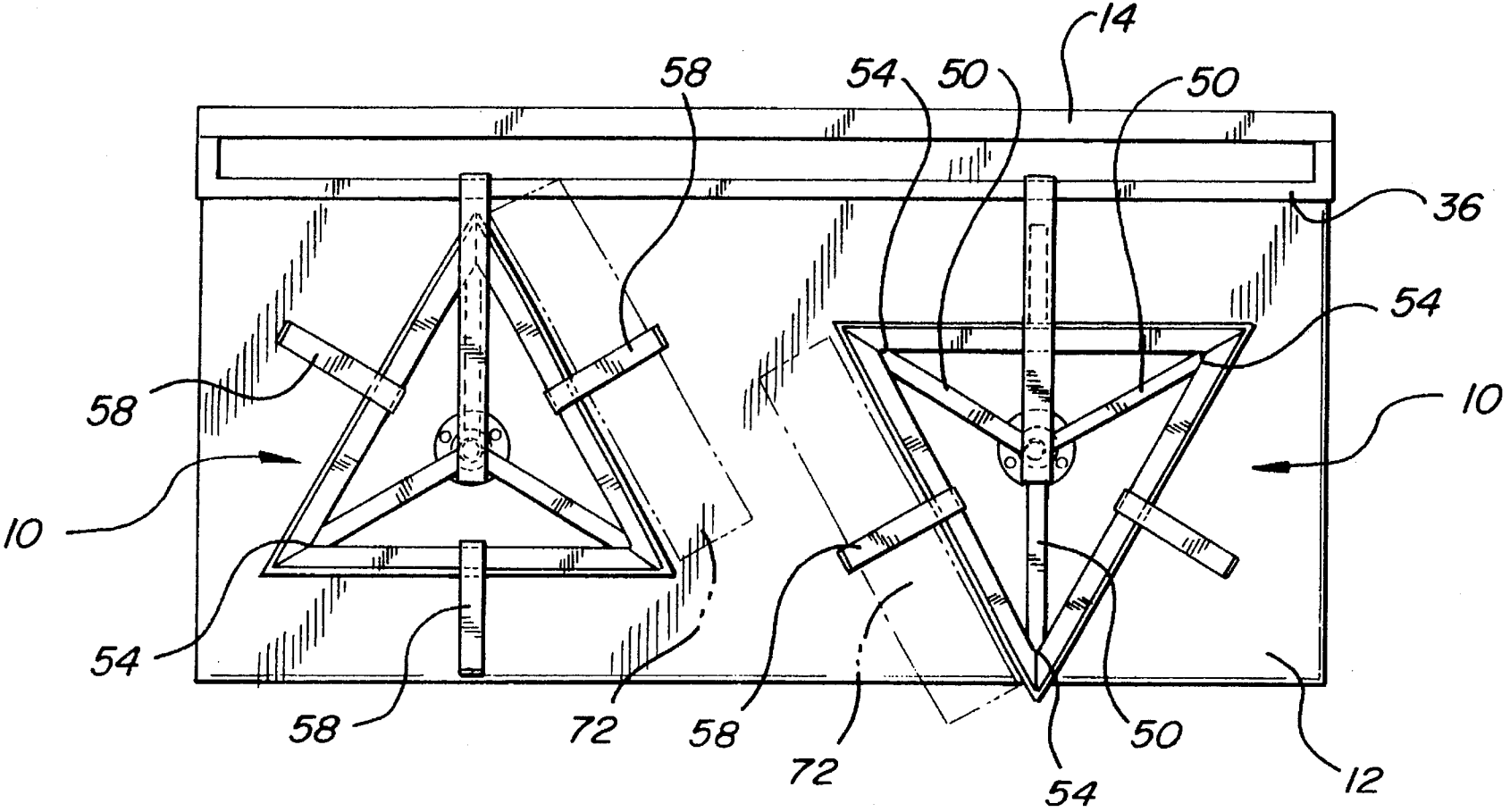
FIG. 2 is a top view of multiple revolving display stands of the subject invention.

Referring to FIG. 1, the articles of merchandise being displayed are floor mats 66 packaged in a display envelope 68 having a clamp hanger 70. An example of the display envelope 68 can be found in U.S. Pat. No. 5,257,694, of common assignee herewith and issued Nov. 2, 1993. The clamp hanger 70 is hooked around the display bar 58 such that the floor mats 66 are hung therefrom. The cantilevered beam 40 extends perpendicular from the mounting bracket 36 so that the pole 24 of the display stand 10 is parallel with the upright wall portion 14 and spaced sufficiently therefrom to allow the free rotation of the display stand 10 about the first 30 and second 44 rotation means. FIG. 2 is a top view of the display stand 10 and illustrates multiple display stands 10 side by side for displaying articles of merchandise 66. FIG. 2 also illustrates, in phantom, an area 72 in which multiple display envelopes 68 containing floor mats 66 are hung from a display bar 58. Also shown in phantom is a fascia 74 secured to the triangular frame 52 for improving the aesthetic appearance of the display stand 10.

Figure 3:
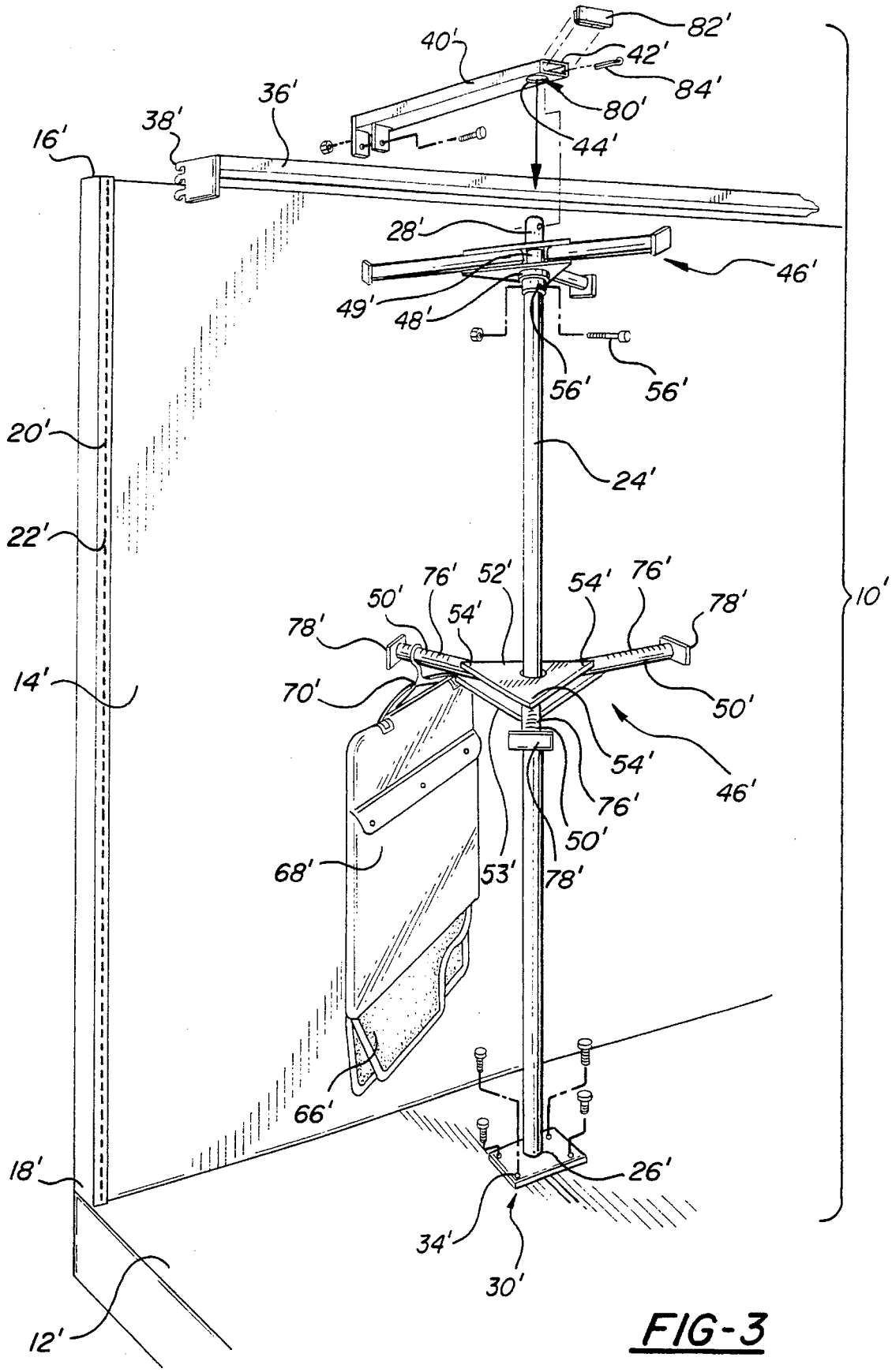
FIG. 3 is a partially exploded perspective view of a second embodiment of the revolving display stand of the subject invention showing packaged floor mats hanging therefrom.

FIG. 3 shows a second embodiment of the display stand 10 wherein like numerals, although primed, indicate the same items described above and shown in FIGS. 1 and 2. The display stand 10' shown in FIG. 3 is similar to the display stand 10 as shown in FIGS. 1 and 2 except for the following described differences and additional features.

The pole 24' is no longer rotatable but is instead fixed. Instead, each display stand 46' is rotatable about the pole 24'. To this end, the display stand 10' comprises first attachment means 30' adapted to be secured to the base floor portion 12' for fixedly attaching the first end 26' of the pole 24' to the base floor portion 12'. First attachment means 30' comprises a plate 34' fixedly secured to the first end 26' of the pole by conventional means, such as by welding, and is adapted to be secured to the base floor portion 12' by bolts. Also to this end, the cantilevered beam 40' has a second attachment means 44' for fixedly securing the second end 28' of the pole 24' to the beam 40'. The second attachment means 44' comprises an aperture 80' in the beam 40' adjacent to the distal end 42' for receiving the second end 28' of the pole 24' and a cotter pin 80' extending through the second end 28' for preventing the withdrawal of the pole 24' from the aperture 44'. The pole 24' is thus fixedly secured between the first and second attachment means 30',44'. The distal end 42' of beam 40' includes a removable cap 82' for accessing the cotter pin 84'. The cotter pin 84' can be removed from the pole 24' so that the pole 24' can be removed from the aperture 44' of the beam 40'.

The display stand 10' shown in FIG. 3 is characterized by at least one display rack 46' rotatable about said pole 24'. The display rack 46' includes a collar 48' secured to the pole 24', an upper 52' and a lower 53' support plate, a bearing unit 49' mounted to and between the upper and lower support plates 52',53' such that the bearing unit 49' and the upper 52' and lower 53' support plates are rotatable about the pole 24' and supported upon the collar 48'. The bearing unit 49' allows for smooth rotation between the pole 24' and the display rack 46'. The upper 52' and lower 53' plates are triangularly shaped. The display rack 46' also includes support arms 50' extending radially outwardly from the bearing unit 49', intersecting the apexes 54' of the upper and lower triangular plates 52', 53' and extending beyond the support plates 52', 53' for supporting the articles of merchandise 66' to be displayed. The support arms 50' include a plurality of indentations 76' for receiving the articles of merchandise 66' to be hung and displayed therefrom. Each support arm 50' also includes an end member 78' for preventing the inadvertent removal of the articles of merchandise 66' hung and displayed therefrom and for displaying merchandise 66' information thereon.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

We claim:

1. An upright revolving display stand (10) of the type for displaying articles of merchandise (66) and of the type supported by both a base floor portion (12) and an upright wall portion (14) extending from the base floor portion (12), said revolving display stand (10) comprising:

a pole (24) having a first end (26) and a second end (28);

first rotation means (30) adapted to be secured to the base floor portion (12) for rotatably supporting said first end (26) of said pole (24);

a mounting bracket (36) adapted to be secured to the upright wall portion (14);

a cantilevered beam (40) extending outwardly from said mounting bracket (36) to a distal end (42,42'); said cantilevered beam (40) having second rotation means (44) at said distal end (42) for rotatably supporting said second end (28) of said pole (24) so that said pole (24) is rotatable about said first (30) and second (44) rotation means; and characterized by at least one display rack (46) including a collar (48) secured to said pole (24), three support arms (50) extending radially from said collar (48), and a triangular frame (52) attached to said support arms (50) at the apexes (54) thereof for supporting the articles of merchandise (66) to be displayed.

2. A revolving stand (10) as set forth in claim 1 further characterized by a bolt (56) extending through said collar (48) and said pole (24) for securing said display rack (46) to said pole (24).

3. A revolving display stand (10) as set forth in claim 1 further characterized by at least display bar (58) extending outwardly from said frame (52) for hanging the articles of merchandise (66) to be displayed.

4. A revolving display stand (10) as set forth in claim 3 further characterized by each of said display bars (58) comprising a first end (60), a second end (62), a saddle portion (64) located at said first end (60) for straddling said frame (52) such that each of said display bars (58) extend outwardly from said frame (52) to said second end (62) in a rigid manner.

5. A revolving display stand (10) as set forth in claim 4 further characterized by each of said display bars (58) having a blocking tab (65) located at said second end (62) for preventing inadvertent removal of the articles of merchandise (66) hung from each of said display bars (58).

6. A revolving display stand (10) as set forth in claim 1 further characterized by said cantilevered beam (40) extending perpendicular from said mounting bracket (36).

7. A revolving display stand (10) as set forth in claim 1 further characterized by said mounting bracket (36) having hooks (38) extending therefrom for adjustably securing said mounting bracket (36) to the upright wall portion (14).

8. A revolving display stand (10) as set forth in claim 1 wherein said first rotation means (30) comprises a bottom guide pin (30) including a pin portion (32) and a plate (34) adapted to secure said bottom guide pin (30) to the base floor portion (12).

9. A revolving display stand (10) as set forth in claim 1 wherein said second rotation means (44) comprises a top guide pin (44) extending from said cantilevered beam (40) at said distal end (42).

10. An upright revolving display stand (10') of the type for displaying articles of merchandise (66') and of the type supported by both a base floor portion (12') and an upright wall portion (14') extending from the base floor portion (12'), said revolving display stand (10') comprising:

a pole (24') having a first end (26') and a second end (28');

first attachment means (30') adapted to be secured to the base floor portion (12') for fixedly attaching said first end (26') of said pole (24') to the base floor portion (12');

a mounting bracket (36') adapted to be secured to the upright wall portion (14');

a cantilevered beam (40') extending outwardly from said mounting bracket (36') to a distal end (42'); said cantilevered beam (40') having a second attachment means (44') for fixedly securing said second end (28') of said pole (24') to said beam (40'); and characterized by at least one display rack (46') rotatable about said pole (24') and including a collar (48') secured to said pole (24') , an upper (52') and a lower (53') support plate, a bearing unit (49') mounted to and between said upper and lower support plates (52', 53') such that said bearing unit (49') and said upper (52') and lower (53') support plates are rotatable about said pole (24') and supported upon said collar (48'), and support arms (50') extending radially from said bearing unit (49') outwardly beyond said support plates (52',53') for supporting articles of merchandise (66') to be displayed.

11. A revolving display stand (10') as set forth in claim 10 wherein said support arms (50') include a plurality of indentations (76') for receiving the articles of merchandise (66') to be hung and displayed therefrom.

12. A revolving display stand (10) as set forth in claim 10 wherein said support arms (50') include an end member (78') for preventing the inadvertent removal of the articles of merchandise (66') hung and displayed therefrom and for displaying merchandise (66') information.

13. A revolving display stand (10') as set forth in claim 10 wherein said first attachment means comprises a plate (34') fixedly secured to said first end (26') of said pole (24') and adapted to be secured to the base floor portion (12').

14. A revolving display stand (10') as set forth in claim 10 wherein said second attachment means (44') comprises an aperture (80') in said beam (40') adjacent to said distal end (42') for receiving said second end (28') of said pole (24') and a cotter pin (80') extending through said second end (28') for preventing the withdrawal of said pole (24') from said aperture (44') .

15. A revolving display stand (10') as set forth in claim 10 wherein said distal end (42') of said beam (40') includes a removable cap (82') for accessing said cotter pin (84') .

16. A revolving display stand (10') as set forth in claim 10 further characterized by said cantilevered beam (40') extending perpendicular from said mounting bracket (36') .

17. A revolving display stand (10') as set forth in claim 10 further characterized by said mounting bracket (36') having hooks (38') extending therefrom for adjustably securing said mounting bracket (36') to the upright wall portion (14') .

18. A revolving display stand (10') as set forth in claim 10 wherein said upper (52') and lower (53') plates are triangularly shaped.

19. A revolving display stand (10') as set forth in claim 18 wherein each of said support arms (50') intersects the apexes (54') of said upper (52') and lower (53') plates.

* * * * *